US010017882B2

(12) United States Patent
Takashima

(10) Patent No.: US 10,017,882 B2
(45) **Date of Patent: *Jul. 10, 2018**

(54) THREAD PRODUCTION DEVICE

(71) Applicant: MURATA MACHINERY, LTD., Kyoto-shi, Kyoto (JP)

(72) Inventor: Hiroki Takashima, Kyoto (JP)

(73) Assignee: MURATA MACHINERY, LTD., Kyoto (JP)

( * ) Notice: Subject to any disclaimer, the term of this patent is extended or adjusted under 35 U.S.C. 154(b) by 233 days.

This patent is subject to a terminal disclaimer.

(21) Appl. No.: 14/904,825

(22) PCT Filed: Jul. 22, 2013

(86) PCT No.: PCT/JP2013/069770

§ 371 (c)(1),
(2) Date: Jan. 13, 2016

(87) PCT Pub. No.: WO2015/011755

PCT Pub. Date: Jan. 29, 2015

(65) Prior Publication Data

US 2016/0138202 A1 May 19, 2016

(51) Int. Cl.
*D01H 1/04* (2006.01)
*D02G 3/16* (2006.01)
(Continued)

(52) U.S. Cl.
CPC ..... *D01H 1/04* (2013.01); *B65H 54/2896* (2013.01); *D02G 3/16* (2013.01);
(Continued)

(58) Field of Classification Search
CPC ..... D01H 1/04
See application file for complete search history.

(56) References Cited

U.S. PATENT DOCUMENTS 808,084 A 12/1905 Hardman
1,446,646 A * 2/1923 Hardman ..... D01H 1/04 57/68

(Continued)

FOREIGN PATENT DOCUMENTS

JP 2010-65339 A 3/2010
WO 2012/127814 A1 9/2012

OTHER PUBLICATIONS

Jayasinghe et al., "Spinning yarn from long carbon nanotube arrays", Journal of Material Research, vol. 26, No. 5, Dec. 28, 2011, pp. 645-651.

(Continued)

*Primary Examiner* — Shaun R Hurley
(74) *Attorney, Agent, or Firm* — Keating & Bennett, LLP

(57) ABSTRACT

A yarn producing apparatus produces CNT (carbon nanotube) yarn from CNT fibers while causing the CNT fibers to run. The yarn producing apparatus includes a wind driving mechanism that causes a winding shaft provided with a winding tube to rotate about a winding centerline of the winding shaft to wind the CNT yarn onto the winding tube, a twist driving mechanism that causes a guide to rotate around the winding tube and guide the CNT yarn to the winding tube, to twist the CNT fibers and produce the CNT yarn while causing the CNT fibers, CNT yarn, or both to swirl, and a traverse driving mechanism that causes the guide to reciprocate relative to the winding tube along the winding centerline of the winding shaft to cause the CNT yarn to traverse the winding tube.

4 Claims, 2 Drawing Sheets

(51) Int. Cl.
*B65H 54/28* (2006.01)
*D01F 9/127* (2006.01)

(52) U.S. Cl.
CPC ..... *B65H 2701/314* (2013.01); *D01F 9/127* (2013.01); *D10B 2101/122* (2013.01)

(56) References Cited

U.S. PATENT DOCUMENTS

| | | | | | |
|---|---|---|---|---|---|
| 3,174,270 | A * | 3/1965 | Blaschke | D01H 1/04 | 57/264 |
| 3,472,013 | A * | 10/1969 | Adams | D01H 1/04 | 57/117 |
| 4,235,070 | A | 11/1980 | Bravin | | |
| 4,304,091 | A * | 12/1981 | Ragan | D01H 1/00 | 57/100 |
| 4,389,838 | A * | 6/1983 | Adelhard | D07B 7/10 | 57/102 |
| 6,141,948 | A * | 11/2000 | Brazeau | D07B 3/10 | 242/364.12 |
| 2013/0333828 | A1 | 12/2013 | Tashiro | | |
| 2016/0153125 | A1* | 6/2016 | Takashima | D02G 3/16 | 19/150 |
| 2016/0160401 | A1* | 6/2016 | Takashima | D01H 1/115 | 57/333 |

OTHER PUBLICATIONS

Miao et al., "Poisson's ratio and porosity of carbon nanotube dry-spun yarns", Carbon, vol. 48, No. 10, Apr. 10, 2010, pp. 2802-2811.

* cited by examiner

THREAD PRODUCTION DEVICE

BACKGROUND OF THE INVENTION

1. Field of the Invention

The present invention relates to a yarn producing apparatus for producing yarn from fibers while causing the fibers to run.

2. Description of the Related Art

An example of a yarn producing apparatus as described above is disclosed in Japanese Patent Application Laid-Open Publication No. 2010-65339. FIG. 1 of Japanese Patent Application Laid-Open Publication No. 2010-65339 illustrates a ring-type spinning apparatus that twists carbon nanotube fibers and produces carbon nanotube yarn while winding the carbon nanotube yarn.

Carbon nanotube fibers are fibers having a relatively low load-bearing value and a relatively small mass. When the apparatus illustrated in FIG. 1 of Japanese Patent Application Laid-Open Publication No. 2010-65339 is applied to such carbon nanotube fibers, the traveler for yarn guide disposed on the ring fails to be rotated appropriately, and, as a result, the produced yarn may not have sufficient performance.

SUMMARY OF THE INVENTION

Preferred embodiments of the present invention, therefore, provide a yarn producing apparatus capable of producing yarn with sufficient performance.

A yarn producing apparatus according to a preferred embodiment of the present invention produces yarn from fibers while causing the fibers to run. The yarn producing apparatus includes a wind driving mechanism that causes a winding shaft provided with a winding tube to rotate about a winding centerline of the winding shaft to wind the yarn onto the winding tube, a twist driving mechanism that causes a guide to rotate around the winding tube and guide the yarn to the winding tube, to twist the fibers and produce the yarn while causing the fibers, yarn, or both to swirl, and a traverse driving mechanism that causes the guide to reciprocate relative to the winding tube along the winding centerline of the winding shaft to cause the yarn to traverse the winding tube.

In this yarn producing apparatus, the guide that causes the yarn to traverse the winding tube is rotated around the winding tube, such that the fibers, yarn, or both swirl, the fibers are twisted, and the yarn is produced. Even when applied to fibers such as carbon nanotube fibers that have a relatively low load-bearing value and a relatively small mass, the fibers are twisted appropriately. The fibers, yarn, or both are twisted and a balloon (the fibers, yarn, or both expanding like a balloon under centrifugal force) is provided such that the balloon appropriately absorbs tension variations produced in relatively less elastic fibers such as carbon nanotube fibers, and the fibers are twisted efficiently. This yarn producing apparatus thus produces yarn with sufficient performance.

In a yarn producing apparatus according to a preferred embodiment of the present invention, the fibers may be carbon nanotube fibers, and the yarn may be carbon nanotube yarn. The twist driving mechanism may twist the fibers and produce the yarn while forming a balloon by swirling the fibers, yarn, or both. Even when applied to carbon nanotube fibers having a relatively low load-bearing value and a relatively small mass, the unique structure described above produces carbon nanotube yarn with sufficient performance.

A yarn producing apparatus according to a preferred embodiment of the present invention may further include a substrate support that supports a carbon nanotube forming substrate, the carbon nanotube fibers being drawn from the carbon nanotube forming substrate. With this unique structure, carbon nanotube fibers are stably supplied.

A yarn producing apparatus according to a preferred embodiment of the present invention may further include a frame that supports the wind driving mechanism and the traverse driving mechanism; and a stage attached to the frame so as to be capable of reciprocating along the winding centerline of the winding shaft and supporting the twist driving mechanism. The wind driving mechanism may include a wind driving source fixed to the frame, and a winding force transmitting mechanism that rotates the winding shaft about the winding centerline of the winding shaft by driving force of the wind driving source. The twist driving mechanism may include a twist driving source fixed to the stage, and a twisting force transmitting mechanism that rotates the guide around the winding tube by driving force of the twist driving source. The traverse driving mechanism may include a traverse driving source fixed to the frame, and a traverse force transmitting mechanism that causes the stage to reciprocate along the winding centerline of the winding shaft by a driving force of the traverse driving source to cause the guide to reciprocate relative to the winding tube along the winding centerline of the winding shaft. In this configuration, each of the wind driving source, the twist driving source, and the traverse driving source is able to be controlled independently, and each of the winding operation, the twisting operation, and the traverse operation is carried out appropriately.

Preferred embodiments of the present invention provide a yarn producing apparatus capable of producing yarn with sufficient performance.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described in details below with reference to the figures. It should be noted that the same or corresponding elements or portions in the figures are denoted with the same reference signs and an overlapping description will be omitted.

Figure 1:
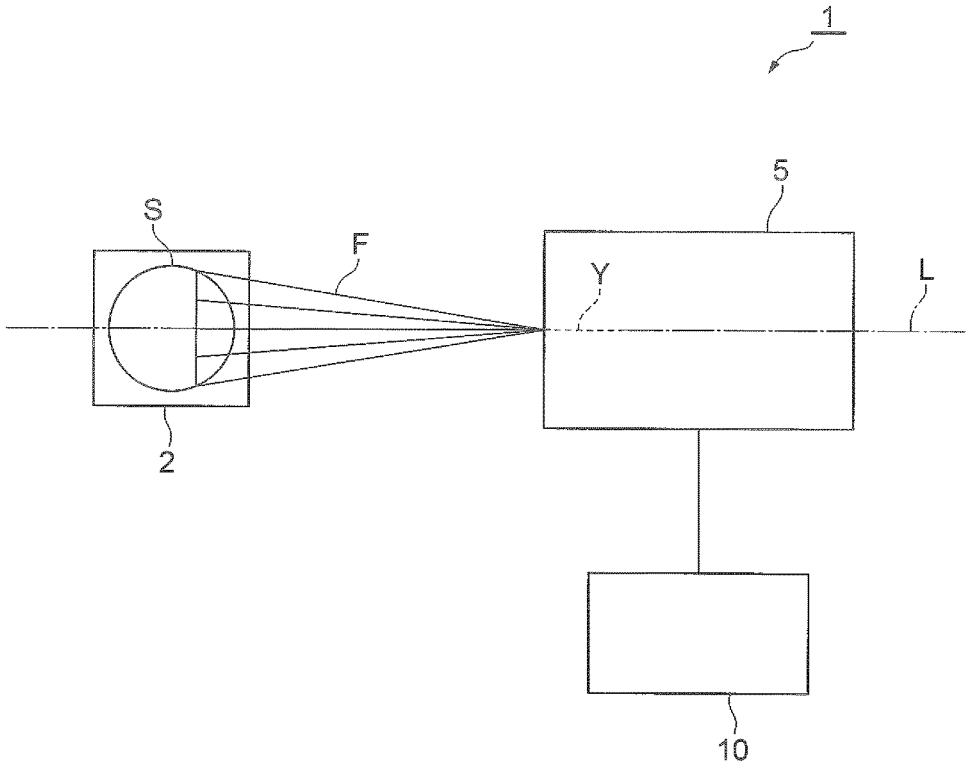
FIG. 1 is a plan view of a yarn producing apparatus according to a preferred embodiment of the present invention.

As shown in FIG. 1, a yarn producing apparatus 1 is an apparatus that produces carbon nanotube yarn (hereinafter referred to as "CNT yarn") Y from carbon nanotube fibers (hereinafter referred to as "CNT fibers") F while causing the CNT fibers F to run. The yarn producing apparatus 1 includes a substrate support 2, a twisting and winding device 5, and a controller 10. The substrate support 2 and the twisting and winding device 5 are arranged on a predetermined straight line L. The CNT fibers F run from the substrate support 2 toward the twisting and winding device 5. The controller 10 controls the operation of the twisting and winding device 5. The CNT fibers F preferably are a set of a plurality of fiber threads (fibers) of carbon nanotube, for example. The CNT yarn Y is the twisted (genuine-twisted or false-twisted) CNT fibers F. Hereinafter, the upstream side in the direction of the CNT fibers F running is simply referred to as "upstream side" and the downstream side in the direction of the CNT fibers F running is simply referred to as "downstream side".

The substrate support 2 supports a carbon nanotube forming substrate (hereinafter referred to as "CNT forming substrate") S from which the CNT fibers F are drawn, in a state of holding the CNT forming substrate S. The CNT forming substrate S is called a carbon nanotube forest or a vertically aligned carbon nanotube structure in which high-density and highly-oriented carbon nanotubes (for example, single-wall carbon nanotubes, double-wall carbon nanotubes, or multi-wall carbon nanotubes) are formed on a substrate by chemical vapor deposition or any other process. Examples of the substrate include a glass substrate, a silicon substrate, and a metal substrate. For example, at the start of production of the CNT yarn Y or during replacement of the CNT forming substrates S, a tool called a microdrill can be used to draw the CNT fibers F from the CNT forming substrate S. In place of a microdrill, a suction device, an adhesive tape, or any other means may be used to draw the CNT fibers F from the CNT forming substrate S.

Figure 2:
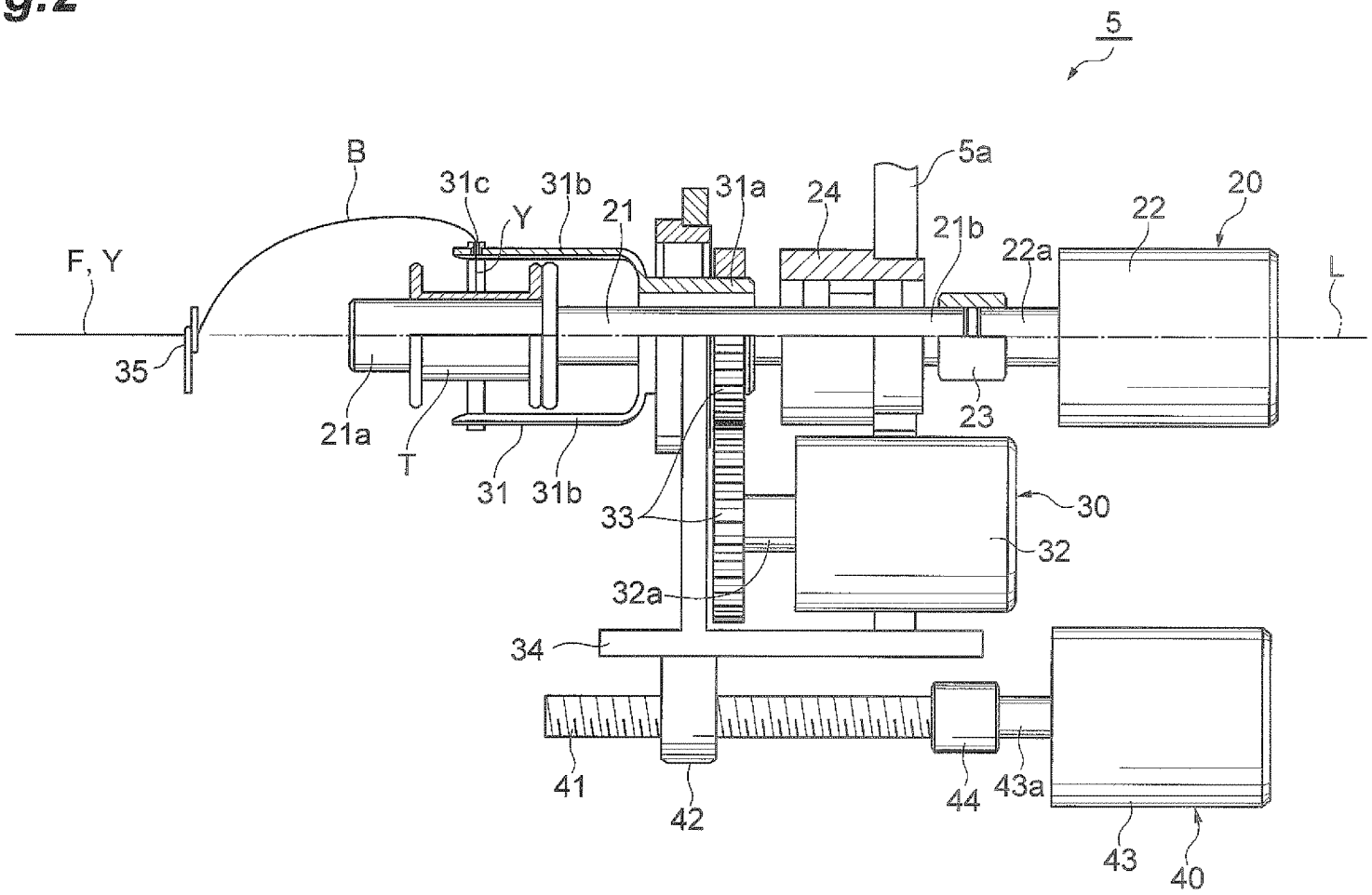
FIG. 2 is a partial cross-sectional view of a twisting and winding device in the yarn producing apparatus shown in FIG. 1.

The twisting and winding device 5 winds the produced CNT yarn Y onto a winding tube while twisting the CNT fibers F drawn from the CNT forming substrate S. More specifically, as shown in FIG. 2, the twisting and winding device 5 includes a wind driving mechanism 20 that winds the CNT yarn Y onto a winding tube T, a twist driving mechanism 30 that twists the CNT fibers F and producing the CNT yarn Y while causing the CNT fibers F, CNT yarn Y, or both to swirl, and a traverse driving mechanism 40 that causes the CNT yarn Y to traverse the winding tube T. The twisting and winding device 5 further includes a frame 5*a* that supports the wind driving mechanism 20 and the traverse driving mechanism 40, and a stage 34 that supports the twist driving mechanism 30.

The wind driving mechanism 20 includes a winding shaft 21 with the winding centerline on the predetermined line L and a wind driving motor (wind driving source) 22 to rotate the winding shaft 21. The winding tube T is attached to a tip end portion 21*a* that is the upstream end of the winding shaft 21, and is removable from the winding shaft 21. A base end portion 21*b* that is the downstream end of the winding shaft 21 is coupled to the drive shaft 22*a* of the wind driving motor 22 with a shaft coupling 23. The winding shaft 21 is supported on a frame 5*a* of the twisting and winding device 5 with a bearing 24. The wind driving motor 22 is fixed to the frame 5*a*.

The wind driving mechanism 20 as described above winds the CNT yarn Y onto the winding tube T by driving the wind driving motor 22 so that the winding shaft 21 provided with the winding tube T is rotated about the winding centerline (that is, the predetermined line L). In this wind driving mechanism 20, a winding force transmitting mechanism includes the shaft coupling 23. The winding force transmitting mechanism rotates the winding shaft 21 about the winding centerline thereof by the driving force of the wind driving motor 22.

The twist driving mechanism 30 includes a guide 31 that guides the CNT yarn Y to the winding tube T and a twist driving motor (twist driving source) 32 that rotates the guide 31 around the winding tube T. The guide 31 includes a tubular body 31*a* surrounding the winding shaft 21 and a pair of arms 31*b* extending on the upstream side from the body 31*a*. A tip end portion that is the upstream end of one arm 31*b* includes an insertion hole 31*c* through which the CNT yarn Y is inserted to be guided to the winding tube T. The CNT yarn Y to be inserted through the insertion hole 31*c* is passed through a guide ring 35 arranged on the predetermined line L in a state of the CNT fibers F, CNT yarn Y, or both, and guided to the winding tube T. The body 31*a* of the guide 31 is coupled to the drive shaft 32*a* of the twist driving motor 32 with a plurality of spur gears 33. The twist driving motor 32 is fixed to the stage 34. The stage 34 is attached to the frame 5*a* so as to be capable of reciprocating along the winding centerline of the winding shaft 21. For example, a bush that defines and functions as a slide bearing may be disposed between the winding shaft 21 and the body 31*a*.

The twist driving mechanism 30 as described above twists the CNT fibers F and produces the CNT yarn Y while causing the CNT fibers F, CNT yarn Y, or both to swirl on the guide ring 35 defining and functioning as a fulcrum and forming a balloon B of the CNT fibers F, CNT yarn Y, or both, by driving the twist driving motor 32 so that the guide 31 that guides the CNT yarn Y to the winding tube T is rotated around the winding tube T. The term "the CNT fibers F, CNT yarn Y, or both" inclusively means the CNT fibers F in a raw state, the CNT fibers F twisted into the CNT yarn Y, and the intermediate fiber portions therebetween. In this twist driving mechanism 30, a twisting force transmitting mechanism includes the spur gear 33. The twisting force transmitting mechanism rotates the guide 31 around the winding tube T by the driving force of the twist driving motor 32.

The traverse driving mechanism 40 includes a ball screw shaft 41 with the centerline parallel or substantially parallel to the predetermined line L, a ball screw nut 42 screwed onto the ball screw shaft 41, and a traverse driving motor (traverse driving source) 43 that rotates the ball screw shaft 41. A base end portion that is the downstream end of the ball screw shaft 41 is coupled to the drive shaft 43*a* of the traverse driving motor 43 with a shaft coupling 44. The ball screw nut 42 is fixed to the stage 34 of the twist driving mechanism 30. The traverse driving motor 43 is fixed to the frame 5*a*.

The traverse driving mechanism 40 as described above causes the CNT yarn Y to traverse the winding tube T by driving the traverse driving motor 43 so that the ball screw shaft 41 is rotated in the positive direction and the negative direction and the twist driving mechanism 30 reciprocates along the predetermined line L (that is, the guide 31 reciprocates relative to the winding tube T along the winding centerline of the winding shaft 21). In order to cause the CNT yarn Y to traverse the winding tube T, for example, the winding tube T may be allowed to reciprocate relative to the guide 31 along the winding centerline of the winding shaft 21 as long as the guide 31 is able to reciprocate relative to the winding tube T along the winding centerline of the winding shaft 21. In this traverse driving mechanism 40, a traverse force transmitting mechanism includes the ball screw shaft 41, the ball screw nut 42, and the shaft coupling 44. The traverse force transmitting mechanism causes the stage 34 to reciprocate along the winding centerline of the winding shaft 21 by the driving force of the traverse driving motor 43 to cause the guide 31 to reciprocate relative to the winding tube T along the winding centerline of the winding shaft 21.

As described above, in the yarn producing apparatus 1, the guide 31 that causes the CNT yarn Y to traverse the winding tube T is rotated around the winding tube T, such that the CNT fibers F, CNT yarn Y, or both swirl, the CNT fibers F are twisted, and the CNT yarn Y is produced. The CNT fibers F are able to be twisted appropriately although the CNT fibers F are fibers having a relatively low load-bearing value and a relatively small mass. Since the CNT fibers F, CNT yarn Y, or both are twisted and the balloon B is formed, although the CNT fibers F are relatively less elastic fibers, the balloon B is able to appropriately absorb tension variations produced in such CNT fibers F, and the CNT fibers F are able to be twisted efficiently. The yarn producing apparatus 1 thus produces the CNT yarn Y with sufficient performance.

In the yarn producing apparatus 1, the controller 10 controls each of the wind driving motor 22, the twist driving motor 32, and the traverse driving motor 43 independently, so that each of the winding operation, the twisting operation, and the traverse operation is able to be carried out appropriately.

The yarn producing apparatus 1 also includes the substrate support 2 that supports the CNT forming substrate S from which the CNT fibers F are drawn. With this unique structure, the CNT fibers F are able to be stably supplied.

Although preferred embodiments of the present invention have been described above, the present invention is not intended to be limited to the foregoing preferred embodiments of the present invention. For example, the supply source of the CNT fibers F may not be a CNT forming substrate S but may be a device that continuously synthesizes carbon nanotubes to supply the CNT fibers F. An aggregating unit such as a thin tube may be arranged on the upstream side of the twisting and winding device 5. The aggregating unit aggregates the CNT fibers F to such an extent that the CNT fibers F are able to be twisted in the twisting and winding device 5. In the foregoing preferred embodiment, the CNT yarn Y is produced by twisting the CNT fibers F while forming a balloon B. Alternatively, the CNT yarn Y may be produced by twisting the CNT fibers F in a condition in which no balloon B is formed. Various preferred embodiments of the present invention may be applicable to fibers other than carbon nanotube fibers and to yarns other than carbon nanotube yarn.

Preferred embodiments of the present invention provide yarn producing apparatuses that are capable of producing yarn with sufficient performance.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A yarn producing apparatus for producing yarn from fibers while causing the fibers to run, the yarn producing apparatus comprising:

a wind driving mechanism that causes a winding shaft provided with a winding tube to rotate about a winding centerline of the winding shaft to wind the yarn onto the winding tube;

a twist driving mechanism that causes a guide to rotate around the winding tube and guide the yarn to the winding tube to twist the fibers and produce the yarn while causing the fibers, the yarn, or both of the fibers and the yarn to swirl;

a traverse driving mechanism that causes the guide to reciprocate relative to the winding tube along the winding centerline of the winding shaft to cause the yarn to traverse the winding tube; and a controller that controls each of the wind driving mechanism, the twist driving mechanism, and the traverse driving mechanism independently such that the twist driving mechanism twists the fibers and produces the yarn while forming a balloon by swirling the fibers, the yarn, or both of the fibers and the yarn; wherein the fibers are carbon nanotube fibers; and the yarn is a carbon nanotube yarn.

2. The yarn producing apparatus according to claim 1, further comprising a substrate support that supports a carbon nanotube forming substrate from which the carbon nanotube fibers are drawn.

3. The yarn producing apparatus according to claim 2, further comprising:

a frame that supports the wind driving mechanism and the traverse driving mechanism; and a stage attached to the frame and that reciprocates along the winding centerline of the winding shaft and supports the twist driving mechanism; wherein the wind driving mechanism includes:

a wind driving source fixed to the frame; and a winding force transmitting mechanism that rotates the winding shaft about the winding centerline of the winding shaft by driving force of the wind driving source;

the twist driving mechanism includes:

a twist driving source fixed to the stage; and a twisting force transmitting mechanism that rotates the guide around the winding tube by driving force of the twist driving source;

the traverse driving mechanism includes:

a traverse driving source fixed to the frame; and a traverse force transmitting mechanism that causes the stage to reciprocate along the winding centerline of the winding shaft due to a driving force of the traverse driving source to cause the guide to reciprocate relative to the winding tube along the winding centerline of the winding shaft.

4. The yarn producing apparatus according to claim 1, further comprising:

a frame that supports the wind driving mechanism and the traverse driving mechanism; and a stage attached to the frame and that reciprocates along the winding centerline of the winding shaft and supports the twist driving mechanism; wherein the wind driving mechanism includes:

a wind driving source fixed to the frame; and a winding force transmitting mechanism that rotates the winding shaft about the winding centerline of the winding shaft by driving force of the wind driving source;

the twist driving mechanism includes:

a twist driving source fixed to the stage; and a twisting force transmitting mechanism that rotates the guide around the winding tube by driving force of the twist driving source;

the traverse driving mechanism includes:

a traverse driving source fixed to the frame; and a traverse force transmitting mechanism that causes the stage to reciprocate along the winding centerline of the winding shaft due to a driving force of the traverse driving source to cause the guide to reciprocate relative to the winding tube along the winding centerline of the winding shaft.

* * * * *